US005096461A

United States Patent [19]

Frankiewicz et al.

[11] Patent Number: 5,096,461

[45] Date of Patent: Mar. 17, 1992

[54] SEPARABLE COAL-OIL SLURRIES HAVING CONTROLLED SEDIMENTATION PROPERTIES SUITABLE FOR TRANSPORT BY PIPELINE

[75] Inventors: Theodore C. Frankiewicz, Westminster; Samuel C. Hanson, Covina, both of Calif.

[73] Assignee: Union Oil Company of California, Los Angeles, Calif.

[21] Appl. No.: 569,692

[22] Filed: Aug. 22, 1990

Related U.S. Application Data

[63] Continuation-in-part of Ser. No. 332,579, Mar. 31, 1989, abandoned.

[51] Int. Cl.[5] ..... C10L 1/32; C10L 9/00

[52] U.S. Cl. ..... 44/281; 44/620

[58] Field of Search ..... 44/90, 51, 620, 281; 241/15, 27

[56] References Cited

U.S. PATENT DOCUMENTS

| | | | |
|---|---|---|---|
| 1,447,008 | 2/1923 | Bates | 44/51 |
| 1,461,167 | 7/1923 | Trent | 44/51 |
| 3,210,168 | 10/1965 | Morway | 44/51 |
| 4,069,022 | 1/1978 | Metzger | 44/51 |
| 4,089,657 | 5/1978 | Keller | 44/51 |
| 4,090,853 | 5/1978 | Clayfield et al. | 44/51 |
| 4,130,400 | 12/1978 | Meyer | 44/51 |
| 4,130,401 | 12/1978 | Meyer et al. | 44/51 |
| 4,147,519 | 4/1979 | Sawyer, Jr. | 44/51 |
| 4,149,855 | 4/1979 | Kohn et al. | 44/51 |
| 4,163,644 | 8/1979 | Bowers | 44/51 |
| 4,195,975 | 4/1980 | Hamuro et al. | 44/51 |
| 4,201,552 | 5/1980 | Rowell et al. | 44/51 |
| 4,203,728 | 5/1980 | Norton | 44/51 |
| 4,203,729 | 5/1980 | Ishizaki et al. | 44/51 |
| 4,251,229 | 2/1981 | Naka et al. | 44/51 |
| 4,251,230 | 2/1981 | Sawyer, Jr. | 44/51 |
| 4,252,540 | 2/1981 | Yamamura et al. | 44/51 |
| 4,276,054 | 6/1981 | Schmolka et al. | 44/51 |
| 4,284,413 | 8/1981 | Capes et al. | 44/51 |
| 4,288,232 | 9/1981 | Schmolka et al. | 44/51 |
| 4,302,212 | 11/1981 | Yamamura et al. | 44/51 |
| 4,306,883 | 12/1981 | Eckman | 44/51 |
| 4,309,191 | 1/1982 | Hiroya et al. | 44/51 |
| 4,309,192 | 1/1982 | Kubo et al. | 44/51 |
| 4,326,855 | 4/1982 | Cottell | 44/51 |
| 4,330,300 | 5/1982 | Cairns | 44/51 |
| 4,364,741 | 12/1982 | Villa | 44/51 |
| 4,364,742 | 12/1982 | Knitter et al. | 44/51 |
| 4,389,219 | 6/1983 | Naka et al. | 44/51 |
| 4,390,230 | 9/1921 | Bates | 44/51 |
| 4,392,865 | 7/1983 | Grosse et al. | 44/51 |
| 4,403,997 | 9/1983 | Poetschke | 44/2 |
| 4,417,901 | 11/1983 | Ando et al. | 44/51 |
| 4,436,527 | 3/1984 | Yamamura et al. | 44/51 |
| 4,448,585 | 5/1984 | Yoo | 44/51 |
| 4,469,486 | 9/1984 | Shah et al. | 44/51 |
| 4,492,590 | 1/1985 | Schick et al. | 44/51 |
| 4,526,585 | 7/1985 | Burgess et al. | 44/51 |
| 4,529,408 | 7/1985 | Yan | 44/51 |
| 4,565,549 | 1/1986 | Mathiesen et al. | 44/51 |
| 4,601,729 | 7/1986 | Capes et al. | 44/51 |
| 4,622,046 | 11/1986 | D'Intino et al. | 44/51 |
| 4,637,822 | 1/1987 | Niu et al. | 44/51 |
| 4,670,019 | 6/1987 | Paspek | 44/51 |
| 4,671,801 | 6/1987 | Burgess et al. | 44/51 |
| 4,711,643 | 12/1987 | Kemp et al. | 44/51 |
| 4,726,810 | 2/1988 | Ignasiak | 44/51 |
| 4,737,158 | 4/1988 | Antonini et al. | 44/51 |
| 4,744,797 | 5/1988 | Shimada et al. | 44/51 |
| 4,753,660 | 6/1988 | Kellerwessel et al. | 44/51 |
| 4,778,605 | 10/1988 | Anthoney et al. | 210/770 |
| 4,842,616 | 6/1989 | Verhille | 44/51 |

FOREIGN PATENT DOCUMENTS

| | | |
|---|---|---|
| 0029712 | 6/1981 | European Pat. Off. . |
| 0163356 | 12/1985 | European Pat. Off. . |
| 59-115391 | 7/1984 | Japan . |
| 1504234 | 3/1978 | United Kingdom . |

OTHER PUBLICATIONS

G. Papachristodoulou and O. Trass, "Coal Slurry Fuel Technology," *The Canadian Journal of Chemical Engineering*, vol. 65, Apr. 1987, pp. 177-201.

S. K. Batra and A. O'Toole, "Stability and Rheology of the Coal-oil-water Mixtures Prepared in a Complete Combustion Integrator", *Proceedings of the Fourth International Symposium on Coal-Slurry Combustion*, vol. 3, May 10-12, 1982, Orlando, Fla. pp. 1-25.

V. P. Singh, "Coal-#2 Oil Mixtures—Effect of Additives on Stability and Rheological Properties," *Proceedings of the Fourth International Symposium on Coal-Slurry Combustion*, vol. 3, May 10-12, 1982, Orlando, Fla., pp. 1-19.

R. L. Rowell, Y. Wei, and B. J. Marlow, "The Critical Solids Concentration (CSC) as a Property of Coal Slurries," *Proceedings of the Fourth International Symposium on Coal-Slurry Combustion*, vol. 3, May 10-12, 1982, Orlando, Fla., pp. 1-21.

*Primary Examiner*—Carl F. Dees

*Attorney, Agent, or Firm*—Yale S. Finkle; Gregory F. Wirzbicki

[57] ABSTRACT

Slurries of water-saturated coal and liquid hydrocarbon carriers having the properties of low apparent viscosity, controlled sedimentation and easy separation, which properties render the slurries transportable over long distances in conventional oil pipelines to predetermined destinations where they are easily separated into their constituent parts, are prepared by combining coal with a liquid hydrocarbon carrier, a minor amount of water in excess of the amount in the water-saturated coal and, optionally, a surfactant to form a mixture and then agitating the mixture under high shear conditions to form agglomerated coal particles in which water acts as a coordinator bridging layer around and/or among the agglomerated particles.

61 Claims, No Drawings

SEPARABLE COAL-OIL SLURRIES HAVING CONTROLLED SEDIMENTATION PROPERTIES SUITABLE FOR TRANSPORT BY PIPELINE

CROSS-REFERENCE TO RELATED APPLICATIONS

This application is a continuation-in-part of Patent Application Ser. No. 332,579 filed in the U.S. Patent and Trademark Office on Mar. 31, 1989 (and now abandoned). The disclosure of this application is hereby incorporated by reference in its entirety.

BACKGROUND OF THE INVENTION

The present invention relates to mixtures of coal in oil or in other liquid hydrocarbon carriers, which mixtures have controlled sedimentation properties and a sufficiently low viscosity that they can be transported over long distances in conventional oil pipelines and then easily separated into their constituent solid and liquid hydrocarbon phases at the desired destination point.

Large reserves of sub-bituminous coal containing relatively high levels of ash-forming minerals and moisture, frequently more than about 9 weight percent of each, are found in western Canada and in the western United States. The cost of cleaning and then transporting such low rank coals by rail to markets in eastern Canada and the midwestern United States can range from two to four times more than the value of the coal at the mine mouth. Since a number of sub-bituminous coal mines are located close to existing multiple product, commercial pipelines which lead to markets in the midwest and eastern portions of Canada and the United States and since pipeline tariffs for long-distance transport can be significantly less than the cost of rail transportation of bulk products, it is reasonable to consider the use of these existing pipelines for transporting coal which has been cleaned at the mine mouth to market in the form of a slurry at a cost which is hopefully lower than that of conventional rail transport. The fact that there are a significant number of coal-burning and coal-capable utility boilers located within a few miles of these existing commercial pipelines both in Canada and in the United States adds to the cost-saving potential of slurry transport via pipelines.

Proposals have been made to transport coals in the form of coal-water slurries and coal-oil slurries. The transport of coal-water slurries poses several disadvantages. It requires the disposal of large quantities of water at the coal's destination which in turn poses environmental and economic liabilities. Furthermore, pipeline tariffs are related to volume of product transported and, since coal normally represents only about one-third of a slurry's volume, approximately two-thirds of the pipeline tariff would be for the transport of water which has no value as a fuel.

Coal-oil slurries, on the other hand, appear to be a more economical and practical way of transporting coals. First, crude oil and other liquid hydrocarbons are currently transported long distances by pipeline across Canada, the United States, and other countries. Thus, if these oils and other liquid hydrocarbons could be used as a carrier for the coal, the cost of transporting the coal would be only for the actual coal volume plus whatever additional surcharge is imposed as a result of the higher viscosity for the slurry compared to the crude oil or other liquid hydrocarbons normally transported through the pipeline. Unfortunately, the transporting of coal-oil slurries or mixtures have posed a number of insurmountable problems. First, during pipeline shutdown, the coal has a tendency to settle through the oil into a relatively hard pack at the bottom of the pipeline. This hard-packed coal sediment is difficult if not impossible to uniformly redisperse when the pipeline is again put into operation. Also, separating the coal from the oil or other liquid hydrocarbon at the destination point has proved to be difficult. The separation is essential if the oil or other liquid hydrocarbon is to be used for its originally intended purpose, e.g., as a feed to an oil refinery. To qualify for such a use, the oil must have a low particulates and water content, properties which have been found difficult to achieve in the past.

SUMMARY OF THE INVENTION

In accordance with the invention, it has now been found that easily separable mixtures of coal or other carbonaceous solids with crude oil or other liquid hydrocarbon carrier, which mixtures have controlled sedimentation properties and an apparent viscosity suitable for transport via pipeline over long distances, i.e., an apparent viscosity below about 300 centipoises at about 40° F., can be made by mixing the carbonaceous solids with the liquid hydrocarbon carrier and a minor amount of water and subjecting the resultant mixture to high shear conditions, usually by the use of a high intensity mixer. The resultant slurries or mixtures normally contain less than about 60 weight percent of the carbonaceous solids in a state of water saturation, greater than about 35 weight percent of the liquid hydrocarbon carrier and between about 0.5 and 10 weight percent water in addition to that in the water-saturated solids. These mixtures have an apparent viscosity less than about 300 centipoises at 40° F., preferably less than about 100 centipoises at 40° F., and generally yield, after standing for about 168 hours, a sediment containing less than about 64 weight percent of the carbonaceous solids, usually between about 50 and 60 weight percent. Such mixtures can be pumped through a pipeline to a receiving station where the solids can be easily separated from the liquid hydrocarbon carrier such that substantially all of the water remains with the solids, i.e., the separated carrier contains less than about 0.50 weight percent dispersed water and is preferably devoid of water, and greater than about 65 weight percent of the carrier, usually 70 weight percent or greater, is recovered from the slurry. The recovered carrier is a relatively clean liquid, i.e., it usually contains less than about 2.5 weight percent solids, preferably less than about 0.5 weight percent, of substantially undiminished value which is suitable for use as a feedstock in a refinery and/or chemical plant while the recovered solids can be burned as fuel or subjected to further processing.

The carbonaceous solids which may be used to form the mixtures of the invention are normally combustible solids such as lignite, coke, sub-bituminous coal, bituminous coal, anthracite, and the like. The liquid hydrocarbon carrier may be a nonpolar liquid, such as a synthetic crude oil or a natural gas condensate, or a weakly polar hydrocarbon liquid such as a natural crude oil. It has been found that it is sometimes necessary, when using a weakly polar hydrocarbon carrier liquid for the coal or other carbonaceous solids, to include a surfactant in the slurry in order to obtain the desired separation and sedimentation properties. Such a surfactant is normally insoluble in the carrier liquid but soluble in water. A surfactant, when used, is usually present in the slurry in an amount between about 0.01 and 5.0 weight percent.

It has been found that Obed Mountain subbituminous coal from western Canada is suitable for forming the slurries of the invention. Slurries of water-saturated Obed Mountain coal in nonpolar natural gas condensates with a minor amount of water in excess of the water in the coal have been made in accordance with the process of the invention without the use of a surfactant, wetting agent, emulsifier, thickening agent, dispersant, suspending agent, mineral soap, stabilizer or other additive, and have proven to have the appropriate sedimentation and separability properties which enable them to be economically transported many miles, e.g., more than 10 miles and usually over 100 miles, through pipelines in a relatively problem-free environment and subsequently separated into their solid and liquid hydrocarbon constituents. In order to obtain similar properties when forming slurries of Obed Mountain or other sub-bituminous coals with weakly polar carriers such as natural crude oils, it is usually desirable to include an oil-insoluble surfactant in the mixtures subjected to high shear mixing in order to form the slurries of the invention.

DETAILED DESCRIPTION OF THE INVENTION

The present invention is directed to mixtures or slurries of carbonaceous solids such as coal in liquid hydrocarbon carriers such as crude oil, which mixtures have relatively low apparent, viscosities and controlled sedimentation properties enabling them to be transported in conventional pipeline facilities to a predetermined destination where the solids in the slurries can be easily separated from the carrier liquid. For purposes of the invention, "controlled sedimentation" is defined as existing when the sediment formed by coal or other solids settling from a static mixture in a period of 24 hours contains an average of greater than about 45 weight percent but no more than about 62 weight percent solids, such solids content being determined by using a Brookfield Model DV-II v scometer as described in Example 2. In a preferred embodiment, between about 50 and about 60 weight percent solids is contained in the sediment. At these percentages, the sediment forms a loosely packed bed which remains easily redispersible into a slurry of uniform composition.

The carbonaceous solids used to form the slurries of the invention are usually a species of coal such as lignite, sub-bituminous coal, bituminous coal, and anthracite, but may be any carbonaceous solids that can be combusted or treated for the recovery of hydrocarbons. Examples of such solids include char, coke, oil shale, tar sands, bitumen and the like. If the solids comprise lignite or a sub-bituminous coal, they may contain greater than about 9 weight percent water, usually between about 10 and about 35 weight percent water, and may be contaminated with a significant amount of clay and other ash-forming materials. To reduce or dilute these ingredients to tolerable levels, the solids may either be mechanically or chemically cleaned and/or dried, or mixed with a higher rank coal containing lesser amounts of ash-forming constituents and moisture prior to being incorporated into the slurries of the invention.

For purposes of this invention, the inherent moisture content or "water saturation level" of the coal or other solids is defined as the weight percent water in the solids after they have stood at a temperature of about 21°-24° C. and a relative humidity of about 100 percent for a period of 72 hours. The weight percent water is determined by subtracting from the weight of a 1 to 2 gram sample of solids which has stood under the appropriate conditions for 72 hours, the weight of that sample after it has been dried in an open container at 105° C. for 1 hour. The water saturation level of coal usually ranges from about 35 weight percent for lignite down to below about 2 weight percent or less for anthracite and very high rank bituminous coal. Preferred are those coal species wherein the water saturation level is between about 10 and about 30, more preferably between about 10 and 25, weight percent. Examples of specific coals which can be used in the invention are Obed Mountain coal, which is mined in northern Alberta, Canada, and has a water saturation level that can vary between about 10 and about 14 weight percent, and Powder River Basin coal, which is mined in Wyoming and has a water saturation level that varies between about 20 and 30 weight percent.

The coal or other solids used to form the slurry of the invention are preferably ground to a particle size distribution such that the maximum particle size is about 500 microns, i.e., 100 weight percent of the solids will pass through a 35 mesh screen on the U.S. Sieve Series Scale, with at least about 90 weight percent, more preferably at least about 99 weight percent, being less than about 300 microns (about 50 mesh on the U.S. Sieve Series Scale), with between about 50 and about 80 weight percent, most preferably between about 55 and about 65 weight percent, of the particles being less than about 75 microns (about 200 mesh on the U.S. Sieve Series Scale). Normally, at least 50 weight percent of the coal or other solids will have a particle size above about 25 microns with at least about 75 weight percent having a particle size above about 10 microns. The method of grinding is not important and any conventional grinding system may be used. Ball mills, hammer mills, roller mills, or bowl mills are all acceptable. Several methods for establishing the desired particle size distribution are well known in the art and practiced commercially.

The amount of coal or other carbonaceous solids used to form the slurry of the invention is generally less than about 60 weight percent and typically ranges between about 20 and about 55 weight percent of the total slurry composition on a water-saturated basis. It should be kept in mind that, in two-phase fluids, viscosity is controlled by both the viscosity of the carrier liquid and the volumetric content of the solids phase. Thus, the viscosity of a slurry is, at least to some degree, a function of the solids content, and very high concentrations of solids may not be pumpable over any significant distance in a pipeline. On the other hand, very low solids concentrations are not economically desirable since unnecessarily large volumes of liquid would be needed to move small amounts of solids. Consequently, a water-saturated solids concentration of about 35 to about 60 weight percent is preferred, with about 45 to about 55 weight percent being more preferred. In general, the weight ratio of solids to hydrocarbon carrier in the slurry range between about 0.54 and about 1.5, preferably between about 0.82 and 1.2, more preferably between about 0.92 and 1.08, with a most preferred ratio of about 1.0, which ratio represents a slurry in which the weights of water-saturated solids and liquid carrier are approximately equal.

The liquid hydrocarbon suitable for use as the carrier in the slurry of the invention is a hydrocarbon or mixture of hydrocarbons having a viscosity less than about 40 centipoises at 40° F., preferably between about 15 and about 25 centipoises, and is a liquid at ambient pressure and temperature, i.e., a pressure of about 1 atmosphere and a temperature between about 40° and 90° F. Normally, the viscosity of the carrier liquid is not altered during formation of the slurry and is insufficient at ambient temperature and in the absence of additives to suspend or substantially slow the settling of the coal or other solids used. Examples of liquid hydrocarbons suitable for use as the carrier include natural and synthetic crude oils, natural gas liquids or condensates, kerosene, and light distillate oils, such as diesel fuel and home heating oil. Preferred carriers are a light crude petroleum having a viscosity at about 40° F. of less than about 25 centipoises, and natural gas condensates which are composed primarily of $C_5$, $C_6$, $C_7$, and $C_8$ hydrocarbons and have a viscosity of less than about 1.0 centipoise at 40° F. Heavy distillates, residual oils and heavy fuel oils such as No. 6 fuel oil have viscosities which are not suitable for use as the carrier liquid and therefore are not within the scope of the invention.

Since a key property of the slurry of the invention is its ability to be pumped long distances through a pipeline, the apparent viscosity of the slurry must be such that it is suitable for transport through commercial pipelines. The highest viscosities of liquids that are normally transported through these pipelines is about 300 centipoises. Thus, the apparent viscosity of the slurry of the invention should normally be less than this value. Since the viscosity of a slurry is difficult or impossible to directly measure, it is usually expressed as an apparent viscosity which is determined, for purposes of this invention, by measuring the pressure drop per unit length of a uniformly mixed slurry as it is passed at a turbulent flow velocity through a pipe. Apparent viscosity is then read from a calibration curve prepared by plotting the pressure drop per unit length of the pipe for various Newtonian fluids that are passed through the same pipe at the same velocity as the uniform slurry against the known viscosity for each fluid.

Under turbulent flow conditions, the viscosity of a slurry of the invention containing equal weights of carbonaceous solids and hydrocarbon carrier liquid will typically range between about 4 and 6 times that of the carrier liquid itself. Thus, although the slurries of the invention may have apparent viscosities under turbulent flow as high as 300 centipoises at 40° F., their viscosities will usually be less than about 200 centipoises and can even be less than about 100 centipoises at 40° F. Such viscosities are relatively low and are not characteristic of a plastic consistency which implies the presence of a semi-solid or soft solid whose viscosity is extremely high or unmeasurable.

In addition to water-saturated carbonaceous solids and a liquid hydrocarbon carrier, the slurry of the invention also contains water in excess of the water in the water-saturated solids. The amount of excess water required in the slurry is primarily a function of the type of liquid carrier utilized and usually varies between about 0.5 and about 10 weight percent of the total weight of the slurry. For nonpolar carrier liquids, such as natural gas liquids or condensates, diesel fuel, kerosene, heating oil, and synthetic oils derived from oil shale, bitumen and tar sands, which liquids normally contain relatively low amounts of oxygen, sulfur, nitrogen and asphaltenes, preferably less than about 500 ppmw each of oxygen, sulfur and nitrogen and less than about 0.5 weight percent asphaltenes, the amount of water required will normally range between about 0.5 and about 10, usually between about 1 and about 5, weight percent. When more polar liquids such as natural crude oils and other liquids containing higher levels of oxygen, sulfur, nitrogen and asphaltenes are used as the carrier, the amount of water required will generally be larger, usually ranging between about 2 and about 10 weight percent, preferably between about 2 and 5 weight percent. Regardless of whether a weakly polar or nonpolar carrier liquid is used, the amount of water present is always less than the amount of carrier liquid, and therefore the slurry is not an aqueous slurry.

It has been found that, in order for the slurry of the invention to have the desired properties of easy separation and controlled sedimentation, which properties allow the slurry to be transported over long distances through a pipeline to a predetermined location and then separated into solids and liquids at that location, the initial mixture of water-saturated solids, liquid hydrocarbon carrier, and water must be subjected to high speed, high shear mixing or agitation, a step in preparing the final slurry which is described in more detail hereinafter. Under high shear conditions, it has been found that the individual particles of solids, preferentially those less than about 50 microns in size, will associate, flocculute, or agglomerate to form larger entities with water acting as a bridging layer around and/or among the particles. It is believed that this phenomenon imparts to the slurry the desired properties of easy separation and controlled sedimentation.

Although the invention is not limited to any particular theory of operation, it is believed that the flocculated, agglomerated, or otherwise associated coal particles are tightly bound by a coordinated water-bridging layer around the particles, and the association occurs when, under high speed and high shear conditions of mixing, the fast-moving, smaller, water-coated particles bind together when they collide in the slurry. In general, these weakly agglomerated, flocculated, or associated particles will form entities between about 20 and about 200 microns in diameter. Since substantially all of the excess water in the slurry is held or trapped between and among the particles, it does not disperse into the carrier liquid. Consequently, the carrier liquid is substantially free of water and a stabilized "emulsion" is not formed.

Forming the desired particle agglomerates utilizing the high shear, high speed mixing step normally requires that the water associated with the surface of the particles form a layer sufficiently thick to allow the particles to stick to each other. In essence, the water serves as a glue which holds the particles o solids together in the final slurry. Whether or not a sufficient thickness of water can be obtained depends on the surface chemistry of both the coal or other carbonaceous solids and the hydrocarbon carrier liquid utilized. The interface between the coal or other solid particles and the water must have a lower surface energy than either the interface between the solids and the carrier liquid or the interface between the water and carrier liquid. When this occurs, the water will favor association with the surface of the particles and not the carrier liquid. In general, nonpolar carrier liquids such as synthetic oils and natural gas condensates sufficiently repel the water so that a water thickness sufficient to promote particle agglomeration is achieved without the need of a surfactant or other additive. On the other hand, weakly polar hydrocarbon liquids such as natural crude oils and other liquids that contain higher amounts of oxygen, nitrogen, sulfur, and asphaltenes tend not to be conducive to the formation of the desired agglomerates, evidently because the thickness of the water layer on the surface of the particles is not large enough to induce the desired association of particles. In such cases, it is usually necessary to add a surfactant to the mixture of water-saturated carbonaceous solids, liquid carrier, and excess water in order to obtain the desired particle association.

The surfactant acts to tie-up more water on the surface of the particles, thereby facilitating association of the particles during the high speed, high shear mixing step. The hydrophilic portion of the surfactant associates itself with the free water present in the slurry while the hydrophobic portion must associate itself with the surface of the coal which therefore must contain some hydrophobic surface sites. Hydrophobic surfaces are typically found with freshly ground coal or other solids and substantially disappear if the ground coal or solids are allowed to stand in air for any significant period of time, e.g., from about 2 to 3 days, depending upon the particular coal or other solids. Thus, when using a weakly polar carrier liquid and a surfactant in the slurry of the invention, it is normally desirable to prepare the slurry using freshly ground solids or solids which have not been exposed to air for a time sufficient to substantially oxidize the surface of the particles.

Surfactants preferred for use in the present invention will not cause the final slurry to be emulsified, peptized, or otherwise colloidally stabilized so that settling of the agglomerated particles in the slurry is unduly inhibited. While such inhibition may be important to prevent settling of the particles in situations where the total mixture is to be combusted, such extended stability is not necessary and indeed, not desirable, where, as in the present invention, sedimentation is to be controlled, not prevented, and the separability of the coal or other carbonaceous solids from the carrier liquid is to be maintained. In fact, without these controlled sedimentation properties, it is doubtful that separation of the solids from the carrier liquid could be easily and economically accomplished.

The surfactant used in the slurries of the invention is preferably insoluble in the carrier liquid and soluble in water. It is usually present in the slurry in a concentration which ranges between about 0.01 and 5 weight percent, preferably between about 0.01 and about 1.0 weight percent, and most preferably between about 0.01 and 0.5 weight percent, of the total weight of the slurry. Since the surfactant must normally be soluble in water, it should have a hydrophilic-lipophilic balance or HLB value above 10, preferably between about 12 and 18, and most preferably between about 12 and 16. HLB values and their measurement are discussed in detail in the chapter entitled "Macroemulsions" of the book *Nonionic Surfactants: Physical Chemistry* appearing as Volume 23 of the Surfactant Science Series published by Marcel Dekker in 1987. The disclosure of this chapter is hereby incorporated by reference in its entirety.

Preferably, the surfactant is useful as is, i.e., after it is added to the slurry, there should be no need to perform polymerization, other "chemistry in place" processes, or elaborate mechanical operations with the slurry in order to form the desired agglomerates or flocs and to prevent absorption of the carrier liquid by the coal or other carbonaceous solids. All these operations will dramatically increase the costs of the overall slurrying process. Lastly, the surfactant should not significantly alter the combustion and/or ash-forming properties of the carbonaceous solids or reduce the economic utility of the recovered carrier liquid. To this end, the surfactant is typically not an inorganic compound and contains, for example, no sodium or potassium.

One suitable group of surfactants for use in forming the slurries of the invention is nonionic, ethoxylated or propoxylated alkyl substituted phenols. Particularly suitable surfactants are nonionic surfactants comprised of a polymeric chain averaging less than 40, preferably between about 5 and 40, and more preferably between about 7 and 30, polyethylene oxide (PEO) units and terminated, at one end, with nonyl phenol. A particularly preferred type of surfactant is known as NP-10 type surfactant and comprises a polymeric chain averaging about 10 PEO units terminated at one end with nonyl phenol. This surfactant is all "organic" so there is no contribution of an additional ash- or slag-forming salt to the slurry and, as will be shown hereinafter, the agglomerated particles of coal or other solids form, upon settling, a loosely packed bed which can be easily redispersed, with the redispersed slurry being substantially separable into water-saturated coal or other particles and essentially water-free hydrocarbon carrier liquid. Normally, the surfactant used to form the slurry of the invention will have a molecular weight below about 2,000, usually below about 1,000.

The slurries of the present invention are made by passing coal or other carbonaceous solids along with a liquid hydrocarbon carrier into a mixing tank having an internal stirring mechanism. Water is also introduced into the tank in an amount which depends upon the amount of water contained in the coal or other carbonaceous solids and the type of carrier liquid and solids utilized to form the slurry. As mentioned previously, sufficient water must be present in the slurry so that there is at least between about 0.5 and about 10 weight percent water in the final slurry composition in addition to the water contained in the coal or other solids when they are in a water-saturated state. Thus, if the solids passed into the tank are not water-saturated, extra water must be introduced into the tank in order to supply not only any additional water needed to saturate the solids but the desired amount in excess of the saturation level. Also, as mentioned previously, if the carrier liquid is non-polar, the amount of water required is usually less than if the carrier liquid is weakly polar. Moreover, the amount of water required usually decreases as the rank of the coal or other solids increases. If a surfactant is needed to obtain the desired slurry properties, which is normally the case when a weakly polar carrier liquid is used, the surfactant is added to the tank along with the solids, the carrier liquid, and the water.

Once the components of the slurry have been passed into the tank, they are thoroughly mixed in the tank with the internal stirrer, and the resultant mixture is pumped from the bottom of the tank through a recycle line back into the top of the tank in order to maintain the solids uniformly dispersed in the carrier liquid. When it is desired to form the slurry of the invention, the mixture is passed from the mixing tank through a high speed, high shear mixing device which imparts sufficient energy into the mixture to promote the association of particles with water acting as a coordinating bridging layer around or among the associated particles. In general, the amount of shear applied is sufficient to cause the smaller water-coated particles of the solid to associate, agglomerate, or flocculate. Normally, such high shear conditions are established with vigorous and turbulent mixing of the slurry from the mixing tank such that the shear rate is greater than about 10,000 reciprocal seconds, preferably greater than about 20,000 reciprocal seconds, and more preferably between about 40,000 and 60,000 reciprocal seconds. When large amounts of the slurry of the invention are to be prepared, the high shear mixing can be accomplished with a continuous in-line mixer, such as the IKA Works Dispax Reactor. In some instances, centrifugal pumps can be used to supply the required shear conditions. When small batches of slurry are desired, high shear emulsifier blades such as the INDCO R-500 blade may be used. Normally, the required high shear mixing cannot be accomplished by using sonic or ultrasonic agitation techniques.

In some instances, especially when surfactants are present, it has been found that excess shearing of the slurries of the invention can have a detrimental impact on the desired properties of controlled sedimentation and ease of separation. Thus, when an in-line continuous mixer is used to supply the shear required to convert mixtures from the mixing tank discussed above to slurries of the invention, the residence time of the mixtures in the continuous mixer normally ranges between about 0.25 and 2 seconds. On the other hand, when the shear is applied in a batch fashion using high shear emulsifier blades, the batch mixture should be stirred for between about 0.5 and 5 minutes, usually between about 30 and 90 seconds.

After the mixture formed in the mixing tank has been subjected to high shear conditions and converted into the slurry of the invention, it is normally passed to storage tanks to await transportation through a pipeline to a location where it is desired to separate the solids from the carrier liquid and separately utilize the two components as, for example, fuel in a power plant and feed to a refinery or a chemical plant, respectively. It has been found that the slurries of the invention are readily pumpable long distances through oil pipelines using conventional pumps customarily used for pumping of the carrier liquid itself. Moreover, the particles in the slurry of the invention do not tend to form deposits on cold pipeline walls. In flow tests with pipes cooled to about 15° F., no buildup of particles on the walls was noted. Also, the associated particles formed by the high shear mixing do not segregate within the pipe at normal pipeline velocities.

The associated coal or other particles in the slurry are found to form porous flocs or agglomerates which, on standing, form a loosely packed bed in the carrier liquid. This is in contrast to the classified, solidly packed masses typically formed with unagglomerated stabilized coal suspensions. Such packed beds are difficult if not impossible to redisperse, once formed, whereas the low density flocs or agglomerates in the slurry of the invention are readily redispersible back into the carrier liquid. It anticipated that slurries prepared as described herein can be easily and safely pumped in conventional crude oil pipelines to power stations over distances greater than 1,000 miles, typically distances as great as 2,500 miles, or more, without difficulty.

After the slurry of the invention arrives at its destination, usually a power plant, the coal or other solids and the carrier liquid must be separated from each other with the solids going to the power plant and the carrier liquid returned to the pipeline for transport to a refinery, chemical plant, or other place of use. The overall separability of the slurry may be determined by a simple procedure. About 100 grams of the slurry is placed on a 100 mesh (about 150 microns) U.S. Sieve Series Screen mounted onto a 5 inch diameter Buchner funnel supported in a filter flask. A vacuum is then applied to the filter flask. The time required for a uniformly dry solids surface to appear on the filter cake is a measure of separability. The weight of residual solids in the carrier liquid is measured by vacuum-filtering the liquid on Whatman No. 41 filter paper. A slurry containing between about 40 and 75 weight percent carrier liquid is deemed to be "easily separable" for purposes of this invention if (1) the time required to achieve a uniformly dry solids surface on the filter cake, i.e., the absence of liquid carrier on the surface of the filter cake, with at least 65 percent of the starting carrier liquid being recovered, is 30 seconds or less, and (2) less than 2 weight percent of the solids originally in the slurry is lost to the filtrate. Typical results observed with the slurries of the present invention are a dry solids surface within 10 seconds, about 70 percent carrier liquid recovery in 30 seconds, with about 1.0 percent of the solids being found in the carrier liquid.

A gross or primary separation of the solids and carrier liquid can be achieved on a commercial scale using conventional liquid/solids separating equipment such as centrifuges, vacuum or pressure filters, and the like. Typically, screen bowl or solid bowl centrifuges with automatic cake discharge are preferred. In the slurries of the invention, the amount of carrier liquid initially recoverable by such methods is typically between about 65 and 95 weight percent, more usually between about 70 and 85 weight percent, depending upon the characteristics of the agglomerated particle flocs and carrier liquid, the amount of water in excess of the saturation level of the solids, and the particular equipment used. Analysis of the recovered carrier liquid shows that its general distillation range, sulfur content, asphaltene content, viscosity, etc., are all essentially unchanged from those values exhibited before it was used to make up the slurry. The water content, as measured by the Karl Fischer Test, is typically less than about 0.10 weight percent, usually less than about 0.05 weight percent. The recovered carrier liquid usually contains less than about 0.5 weight percent solids.

Additional quantities of carrier liquid can be recovered from the solids removed from the carrier in the gross or primary separation step by washing the recovered solids with a solvent such as heptane, hexane, a mixture of low boiling point hydrocarbons, or with hot water, followed by drying the washed solids at a temperature of about 200° F. to about 400° F., preferably from about 250° F. to about 300° F. When combined with the gross separation step, such techniques typically recover greater than about 95 weight percent of the carrier liquid in the initially formed slurry, with the coal or other solids being readily combustible or otherwise useable and the carrier liquid being substantially unchanged from when it was introduced into the mixture.

This ease of separability is surprising since, with slurries of the prior art, it is found that, after the initial separation step, the solids will typically retain anywhere, on a relative basis, from 10 percent to as much as 50 percent more carrier liquid to that retained by solids from an easily separable slurry of the invention and that the additional liquid recovery steps described above are not as effective in removing residual liquid from the solids. Since the added water and the surfactant, if used, are both relatively inexpensive, the potential economic value of the present invention is readily apparent.

The invention will be further described with reference to the following examples, which are provided to illustrate and not limit the present invention. All slurries discussed in the following examples contain equal weights of water-saturated coal and liquid hydrocarbon carrier.

EXAMPLE 1

Approximately 40 tons of Obed Mountain subbituminous coal were dry-ground in a Model 3036 Combustion Engineering roller mill. The preground coal was screened to remove oversize feedstock with about 1.3 percent being rejected for use. The remainder, which was initially at a nominal ½" to 1" particle size with a moisture content of between about 16 and 18 weight percent, was then fed into the grinder at a rate of 1 ton/hour at a mill speed of 500 RPM with an air flow passing through the mill at a rate of about 4,600 $ft^3$/minute at a temperature of about 200° F. The outlet air temperature was about 95° F. and the final moisture content of the coal was between about 10 and 12 weight percent. The dry weight mineral content of the ground coal was about 15 weight percent. The water saturation level of the coal was about 13 weight percent.

After grinding, the coal was recovered from the mill air flow by passing the air stream through an air cyclone separator. This removed over 95 weight percent of the coal, with the remainder being removed from the air stream in a bag filter. The material captured in the bag comprised fines generally less than 30 microns, more usually less than 10 microns, in diameter. The coal recovered in the air cyclone was analyzed for particle size distribution using a Leeds and Northrop Micro-Trac particle size analyzer and was found to contain 10 weight percent particles less than about 20 microns in diameter, 50 weight percent particles less than about 63 microns in diameter, and 90 weight percent particles less than about 150 microns in diameter. It was found that 100 weight percent of the particles had a diameter less than 300 microns.

EXAMPLE 2

A sample of about 1 pound of the ground coal from Example 1 taken immediately after grinding was water-saturated and together with about 2.4 weight percent excess water and a sufficient amount of an NP-10 type surfactant (Igepal CO-660 from GAF) to comprise about 1,000 ppmw in the final slurry, was mixed in a one-liter beaker for 1 minute with an equal weight of Canadian Peace River crude oil using a mixer equipped with a 1.5-inch diameter high shear INDCO R-500 emulsifier blade operated with a tip speed of about 2,700 ft/min. The Canadian Peace River crude oil had a viscosity at about 68° F. of about 5.4 centipoises and at about 40° F. of about 16 centipoises, a density at about 60° F. of about 0.830 g/cc, and contained about 1.1 weight percent asphaltenes and about 2,700 ppmw sulfur. The sedimentation properties of the slurry formed after the high shear mixing were compared to four similar slurries prepared with (a) no excess water and no surfactant, (b) 1,000 ppmw surfactant but no excess water, (c) 2.4 weight percent excess water and no surfactant, and (d) 2.4 weight percent excess water and 2,000 ppmw surfactant. After mixing, the five slurries were allowed to stand undisturbed in 1-liter glass jars to allow substantially all of the coal to settle. After periods of 24 and 168 hours, a rotating t-bar spindle attached to a Brookfield Model DV-II viscometer mounted on a Brookfield Helipath stand was lowered into each jar at a constant rate and the viscometer's output signal was recorded. By knowing the ratio of recorder chart speed to the vertical velocity of the t-bar spindle as the viscometer is lowered on the stand, the location of the top of the sedimented coal bed in each jar was determined and the average weight percent coal in the sediment calculated based on the geometry of the jar. The results obtained for these five slurries, which are identified as Slurries 1 to 5, respectively, are shown in Table 1. From these tests it was found that the two slurries with both excess water and surfactant (Slurries 1 and 5) had each formed a porous, easily redispersible sediment bed while the two samples without added water (Slurries 2 and 3) had settled into hard-packed, nondispersible beds. The water-treated sample without added surfactant (Slurry 4) behaved somewhat in between.

TABLE 1

| Slurry | Coal Grind | Coal Moisture (Weight %) | Water in Excess of Coal Saturation Level (Wt. %) | NP-10 Surfactant (ppmw) | Weight % Coal in Sediment 24 Hrs | 168 Hrs |
|---|---|---|---|---|---|---|
| 1 | Fresh | 13.0 | 2.4 | 1000 | 50.0 | 51.3 |
| 2 | Fresh | 13.0 | — | — | 64.4 | 65.6 |
| 3 | Fresh | 13.0 | — | 1000 | 64.5 | 67.0 |
| 4 | Fresh | 13.0 | 2.4 | — | 54.3 | 55.5 |
| 5 | Fresh | 13.0 | 2.4 | 2000 | 51.2 | 53.9 |
| 6 | Aged | 13.0 | — | — | 59.4 | 66.5 |
| 7 | Aged | 13.0 | 2.4 | — | 60.7 | 66.9 |
| 8 | Aged | 13.0 | 2.4 | 1000 | 60.3 | 64.5 |
| 9 | Aged | 13.0 | 2.4 | 2000 | 51.2 | 52.5 |
| 10 | Fresh | 8.2 | — | — | 66.3 | 64.6 |
| 11 | Aged | 8.2 | — | — | 62.9 | 65.8 |

Note that the weight percent coal in the slurry sediments product from Slurries 1, 4, and 5, which contained water in addition to the water needed to saturate the coal, was under 56 weight percent, with the sediments of Slurries 1 and 5, which slurries contained the surfactant, having the lowest percentage of coal. These three slurries were also observed to form particle agglomerates when subjected to the high shear mixing step whereas Slurries 2 and 3 did not. As a practical matter, it is found that sediments in Peace River crude oil containing less than about 63 weight percent Obed Mountain coal are most easily redispersible and pumpable with those containing over 66 weight percent Obed Mountain coal being least readily redispersible and not readily pumpable, while 63 to 66 weight percent appears to be a transition zone. It is believed that the formation of particle agglomerates upon high shear mixing is what determines if the sediment is easily redispersible.

EXAMPLE 3

Four additional slurries, i.e., Slurries 6 through 9, were prepared. allowed to settle and tested for sedimentation properties in accordance with the procedures of Example 2 but using a ground coal which, after grinding and before slurry preparation, was aged storage for 3 to 4 days to allow the particle surfaces to oxidize. Slurry 9 was the only slurry in which particle agglomerates were observed to be formed during the high shear mixing step. The results of the sedimentation tests for Slurries 6 through 9 are also shown in Table 1. Note that, except for Slurry 9 which contained 2,000 ppmw surfactant and formed particle agglomerates upon high shear mixing, the amounts of coal in the sediments settling out of suspension, after standing for 168 hours, were all greater than 64 weight percent. As a rule, slurry sediments with this much coal are quite difficult to redisperse and pump in a pipeline. Consequently, for mixtures of coal with oxidized surfaces and crude oil, a greater amount of surfactant is needed to achieve particle agglomeration and the controlled sedimentation which follows therefrom after 168 hours, if it can be achieved at all.

EXAMPLE 4

Two additional slurries, i.e., Slurries 10 and 11, were prepared, allowed to settle and tested for sedimentation properties in accordance with the procedures of Example 2 except the ground coal contained only 8.2 weight percent water, i.e., was unsaturated, and neither excess water nor surfactant was used. Slurry 10 was prepared with the freshly ground coal of Example 2 while Slurry 11 was made with the aged coal of Example 3. Neither slurry was observed to form particle agglomerates during the high shear mixing step. The sedimentation results are shown in Table 1 and are about the same as those for corresponding Slurries 2 and 6 made with saturated coal but no excess water or added surfactant. Slurries 10 and 11 did not have the desired redispersion properties since they yielded greater than about 64 weight percent Obed Mountain coal in the sediment after standing for 168 hours.

EXAMPLE 5

Three separate slurries of coal and natural gas condensate were prepared by mixing about 250 grams of Obed Mountain coal having various moisture contents with 250 grams of an unrefined natural gas condensate. The coal was crushed in a similar procedure to that described in Example 1 and had a similar size distribution. The water-saturation level of the coal was measured to be about 9.7 weight percent. The three slurries after being hand-mixed were subjected to high shear mixing using the emulsifier blade as described in Example 2. No surfactant was added to any of the three slurries. The natural gas condensate used to form these slurries contained 12.02 weight percent $C_5$ hydrocarbons, 31.1 weight percent $C_6$ hydrocarbons, 32.1 weight percent $C_7$ hydrocarbons, and 17.1 weight percent $C_8$ hydrocarbons. The condensate had a viscosity at 40° F. and 68° F. of about 0.50 and about 0.45 centipoise, respectively. The condensate also had a density at 60° F. of 0.633 grams per cubic centimeter, and contained less than 0.1 weight percent asphaltenes and less than 100 ppmw sulfur. After the three slurries were prepared, they were allowed to stand for 24 hours, and the weight percent coal in the sediment was determined in the same manner as described in Examples 2 through 4. The results of these tests are set forth below in Table 2.

TABLE 2

| Coal Moisture (Weight Percent) | Water in Slurry Above Coal Saturation Level (Weight Percent) | Weight Percent Coal in Sediment After 24 Hours |
|---|---|---|
| 10.7 | 0.5 | 63.6 |
| 13.0 | 1.6 | 59.5 |
| 14.5 | 2.4 | 51.9 |

As can be seen from the data in Table 2, the slurry which contained only 0.5 weight percent water in addition to the water-saturation level of the coal yielded a sediment containing 63.6 weight percent coal, which sediment was found to be hard-packed. However, as the excess water in the slurry increased to 2.4 weight percent above the water-saturation level of the coal, the weight percent coal in the sediment dropped to 51.9, a sediment that was found to occupy about 90 volume percent of the total slurry and to be very easily redispersible. It is important to note that this easily redispersible sediment was obtained without the use of a surfactant which was usually found to be necessary to obtain the proper sedimentation properties when using the same type of coal, i.e., Obed Mountain coal, with a crude oil, i.e., Canadian Peace River oil. Evidently, the surfactant is not necessary to obtain the desired sedimentation properties when the hydrocarbon carrier liquid of the slurry is relatively nonpolar as compared to the surface of the coal, and therefore the excess water in the slurry tends to form, without the need of a surfactant, the water bridging required between coal particles to form coal agglomerates upon high shear mixing.

EXAMPLE 6

Approximately 1,500 pounds of ground coal from Example 1 were mixed as described in Example 2 with an equal weight of Canadian Peace River crude oil, 2.4 weight percent water in excess of the water saturation level of the coal and about 2,000 ppmw of an NP-10 type surfactant. The resultant slurry was then pumped through a 4" diameter pipeloop equipped with a high shear centrifugal pump at a rate of about 85 passes therethrough per hour. The calculated turbulent flow viscosity at 20° C. was about 25 centipoises. After about 5 hours of operation, the pump was stopped, and the slurry was statically stored for 4 days in the pipeline. During this time, there was no evidence of a settled out hard pack of coal. On the fifth day, the pump was restarted and the slurry circulation was observed to restore uniformly across the pipe diameter with no difficulty or the requirement of excessive back pressure to initiate flow. A sample of the slurry was removed from the pipeline. About 100 grams of the sample were placed on a 100 mesh U.S. Sieve Series screen mounted into a 5 inch diameter Buchner funnel. A vacuum was then applied to the filter flask supporting the funnel, and it was observed that a uniformly dry solids surface appeared on the filtered coal cake in less than 5 seconds.

EXAMPLE 7

A coal-in-oil mixture was prepared as described in Example 6 using 500 pounds of the ground coal from Example 1 and an equal weight of Canadian Peace River crude oil. The mixture was centrifuged in a Bird 6" continuous screen bowl centrifuge at 1,000 G's and 2.5 gallons per minute loading to separate out the coal. Analysis of the separated coal, which was in the form of a water wet cake, showed that it contained about 17.3 weight percent of crude oil, i.e., the initial oil recovery was about 78 weight percent of the original crude oil in the mixture. A Karl Fischer analysis of the separated oil showed that there was less than 0.1 weight percent water therein, i.e., substantially all the excess water remained with the coal.

EXAMPLE 8

Two slurries, each containing about 5 pounds of a ground water-saturated Obed Mountain coal that had been aged in storage for about 8 days to allow the particle surfaces to oxidize were prepared as described in Example 2 with an equal weight of Canadian Peace River crude oil, 2.4 weight percent water in excess of the water saturation level of the coal, and about 2,000 ppmw of an NP-10 type surfactant. These slurries were similar to Slurry 9 in Table 1 and, like that slurry, were observed to contain particle agglomerates after the high shear mixing step. The resultant slurries were combined into one large slurry which was then fed to a continuous rotary vacuum drum filter apparatus designed to allow the coal cake on the filter to be washed before being removed. The combined slurry was filtered with the rotary vacuum filter adapted so that the immersion time of the filter in the slurry and the open air exposure time of the filter could be adjusted. A portion of the combined slurry was filtered for each of Runs 1 through 4, the results of which runs are set forth in Table 3.

TABLE 3

| Run | Immersion time/ Exposure time (Sec.) | Grams/Min. of Coal Recovered | Wt. Percent Oil from Slurry that Remained with Coal |
|---|---|---|---|
| 1 | 30/30 | 306 | 17.4 |
| 2 | 60/60 | 220 | 18.6 |
| 3 | 15/5 plus Water Wash | 339 | 8.2 |
| 4 | 15/5 plus Heptane Wash | 385 | 3.8 |
| 5 | 30/30 | 238 | 33.5 |
| 6 | 45/45 | 88 | 45.9 |
| 7 | 60/60 | 70 | 31.3 |
| 8 | 60/120 | 46 | 29.6 |
| 9 | 60/120 plus Water Wash | 47 | 32.4 |
| 10 | 60/120 plus Heptane Wash | 46 | 31.1 |

As can be seen from the data for Run 1, about 17 weight percent of the crude oil originally in the slurry remained with the coal when the rotary vacuum filter was adjusted to have immersion and exposure times of 30 seconds each. Thus, about 83 weight percent of the oil originally in the slurry was recovered in this run. As can be seen from Run 2, doubling the immersion and exposure times had little effect on the weight percent oil recovered, whereas Runs 3 and 4 show that washing the resultant filter cake with water or heptane can increase the weight percent oil recovered at reduced immersion and exposure times such that only 8.2 weight percent and 3.8 weight percent of the oil from the slurry, respectively, remain with the coal. The rates at which the coal was recovered from the slurries of Runs 1 through 4 were all quite high, ranging from 220 to 385 grams per minute.

EXAMPLE 9

The procedure of Example 8 was repeated but with a combined slurry which contained only 1,000 ppmw of an NP-10 type surfactant. The combined slurry was similar to Slurry 8 in Table 1 and, like that slurry but unlike the combined slurry of Example 8, did not contain any significant particle agglomeration after the high shear mixing step. The slurry was fed to the continuously rotating vacuum drum filter apparatus as in Example 8. The results observed are shown as Runs 5 to 10 in Table 3. Note that, in all of these runs, the weight percent oil retained on the coal was at least about double that for Runs 1 through 4. Also note that, in Runs 9 and 10, where the immersion time and exposure times were both considerably longer than in Runs 3 and 4 of Example 10, the weight percent carrier oil retained on the coal was much higher, i.e., 3 times greater in Run 9 than in Run 3 and about 9 times greater in Run 10 than in Run 4. Such a high retention of oil by the filter cake indicates that slurries containing oxidized Obed Mountain coal, Peace River crude and water in excess of the coal saturation level are not easily separable unless they contain a sufficient amount of surfactant to induce particle agglomeration during high shear mixing of the slurry. Furthermore, a comparison of Runs 1 and 2 with Runs 5 and 7, respectively, shows that slurries which do not contain such particle agglomerates have a much lower coal recovery rate than slurries containing such agglomerates.

Obviously, many modifications and variations of this invention, as hereinabove set forth, may be made without departing from the spirit and scope thereof, and therefore only such limitations should be imposed as are indicated in the following claims. All embodiments which come within the scope and equivalency of the claims are, therefore, intended to be embraced therein.

We claim:

1. A mixture of carbonaceous solids and a liquid hydrocarbon carrier, said mixture being easily separable and having controlled sedimentation properties which render it suitable for transport through a pipeline and the subsequent separation of said solids from said carrier, which mixture comprises:
   (a) less than about 60 weight percent of said carbonaceous solids, said solids being water-saturated;
   (b) greater than about 35 weight percent of said liquid hydrocarbon carrier, said carrier having a viscosity below about 40 centipoises at about 40° F.; and
   (c) between about 0.5 and 10 weight percent water in addition to the water in said water-saturated carbonaceous solids, wherein said mixture has an apparent viscosity of less than about 300 centipoises at 40° F.

2. A mixture as defined by claim 1 wherein said mixture yields, after standing for about 24 hours, a sediment containing between about 50 and about 60 weight percent carbonaceous solids.

3. A mixture as defined by claim 1 wherein said carbonaceous solids comprise coal.

4. A mixture as defined by claim 3 containing between about 25 and about 60 weight percent water-saturated coal.

5. A mixture as defined by claim 4 containing between about 35 and about 75 weight percent liquid hydrocarbon carrier.

6. A mixture as defined by claim 3 wherein said water in addition to that in said water-saturated coal comprises between about 1 and about 5 weight percent of said mixture.

7. A mixture as defined by claim 3 wherein said coal is selected from the group consisting of lignite and sub-bituminous coal.

8. A mixture as defined by claim 3 wherein 100 weight percent of said coal comprises particles that pass through a 35 mesh screen on the U.S. Sieve Series Scale, 99 weight percent or greater of the coal comprises particles that pass through a 50 mesh screen on the U.S. Sieve Series Scale, and between about 50 and 80 weight percent of said coal comprises particles that pass through a 200 mesh screen on the U.S. Sieve Series Scale.

9. A mixture as defined by claim 3 wherein said liquid hydrocarbon carrier is selected from the group consisting of natural and synthetic crude oils, diesel fuel, natural gas condensates, kerosene, and heating oil.

10. A mixture as defined by claim 3 wherein said coal is a sub-bituminous coal and said liquid hydrocarbon carrier is a natural gas condensate.

11. A mixture as defined by claim 3 wherein said coal is a sub-bituminous coal and said liquid hydrocarbon carrier is a synthetic crude oil.

12. A mixture as defined by claim 3 containing agglomerated coal particles in which water acts as a bridging layer around and/or among the agglomerated particles.

13. A mixture as defined by claim 3 further comprising a surfactant substantially insoluble in said liquid hydrocarbon carrier.

14. A mixture as defined by claim 13 containing between about 0.01 and 5 weight percent of said surfactant.

15. A mixture as defined by claim 13 wherein said surfactant has a HLB value greater than about 10.

16. A mixture as defined by claim 15 wherein said surfactant comprises one or more nonionic ethoxylated or propoxylated alkyl substituted phenols.

17. A mixture as defined by claim 15 wherein said surfactant comprises a polymeric chain averaging less than about 40 polyethylene oxide units and terminated, at one end, with nonyl phenol.

18. A mixture as defined by claim 17 wherein said surfactant comprises a polymeric chain averaging about 10 polyethylene oxide units and terminated, at one end, with nonyl phenol.

19. A mixture as defined by claim 15 wherein said coal is a sub-bituminous coal and said liquid hydrocarbon carrier is a natural crude oil.

20. A mixture as defined by claim 18 wherein said coal is Obed Mountain coal and said liquid hydrocarbon carrier is a natural crude oil.

21. A mixture as defined by claim 20 wherein said crude oil is Canadian Peace River oil.

22. A mixture as defined by claim 3 having an apparats viscosity at 40° F. of less than about 100 centipoises.

23. A mixture of coal and a liquid hydrocarbon carrier having an apparent viscosity of less than about 300 centipoises at 40° F., said mixture being easily separable and having controlled sedimentation properties which render it suitable for transportation through a pipeline and the subsequent separation of said coal from said carrier, which mixture is made by the process comprising:

(a) combining coal with a liquid hydrocarbon carrier and water to form a mixture, said mixture containing water-saturated coal and water in excess of the water saturation level of said coal; and (b) subjecting said mixture to high shear conditions sufficient to cause the particles of coal to form agglomerates such that water acts as a bridging layer around and/or among the agglomerated particles, thereby forming said easily separable mixture having controlled sedimentation properties.

24. A mixture as defined by claim 23 wherein said coal is selected from the group consisting of lignite and a sub-bituminous coal having a water-saturation level above about 9 weight percent.

25. A mixture as defined by claim 24 wherein said liquid hydrocarbon carrier is a natural gas condensate or a synthetic crude oil.

26. A mixture as defined by claim 25 consisting essentially of said water-saturated coal, said liquid hydrocarbon carrier and said excess water.

27. A mixture as defined by claim 23 further comprising a surfactant substantially insoluble in said liquid hydrocarbon carrier, said surfactant having an HLB value between about 12 and about 18.

28. A mixture as defined by claim 27 wherein said coal is selected from the group consisting of lignite and a sub-bituminous coal having a water-saturation level above about 9 weight percent, said liquid hydrocarbon carrier is a crude oil having a viscosity below about 40 centipoises at 40° F. and said surfactant comprises a polymeric chain averaging about 10 polyethylene oxide units and terminated, at one end, with nonyl phenol.

29. A process for making a mixture of carbonaceous solids and a liquid hydrocarbon carrier, said mixture being suitable for transportation through a pipeline and the subsequent separation of said solids from said carrier, which process comprises:

(a) combining carbonaceous solids with a liquid hydrocarbon carrier and water to form a slurry, said slurry containing water-saturated carbonaceous solids and water in excess of the amount in said water-saturated solids; and (b) subjecting said slurry to high shear conditions to form said mixture, wherein said high shear conditions are sufficient to cause particles of said carbonaceous solids to associate with each other such that water acts as a bridging layer around and/or among the associated particles.

30. A process as defined by claim 29 wherein said carbonaceous solids comprise coal.

31. A process as defined by claim 30 wherein said coal is selected from the group consisting of lignite and a sub-bituminous coal.

32. A process as defined by claim 30 wherein said coal prior to being combined with said liquid hydrocarbon carrier and said water has been ground to a particle size distribution such that at least about 99 weight percent of the coal particles pass through a 50 mesh screen on the U.S. Sieve Series Scale and between about 50 and 80 weight percent of the coal particles pass through a 200 mesh screen on the U.S. Sieve Series Scale.

33. A process as defined by claim 30 wherein said liquid hydrocarbon carrier is selected from the group consisting of natural and synthetic crude oils, natural gas condensates, kerosene, diesel fuel, and heating oil.

34. A process as defined by claim 30 wherein said slurry subjected to said high shear conditions contains between about 25 and 60 weight percent water-saturated coal, between 35 and 75 weight percent liquid hydrocarbon carrier, and between about 1 and 5 weight percent water in excess of the amount in said water-saturated coal.

35. A process as defined by claim 30 wherein said coal is a sub-bituminous coal and said liquid hydrocarbon carrier is a natural gas condensate.

36. A process as defined by claim 30 wherein a surfactant is added to said slurry subjected to said high shear conditions, said surfactant being substantially insoluble in said liquid hydrocarbon carrier.

37. A process as defined by claim 36 wherein said surfactant has a HLB value above about 10.

38. A process as defined by claim 37 wherein a sufficient amount of said surfactant is added to said slurry so that the mixture formed in step (b) contains between about 0.01 and 5 weight percent of said surfactant.

39. A process as defined by claim 37 wherein said surfactant comprises one or more nonionic ethoxylated or propoxylated alkyl substituted phenols.

40. A process as defined by claim 37 wherein said surfactant comprises a polymeric chain averaging between about 7 and about 30 polyethylene oxide units and terminated, at one end, with nonyl phenol.

41. A process as defined by claim 10 wherein said surfactant comprises a polymeric chain averaging about 10 polyethylene oxide units and terminated, at one end, with nonyl phenol.

42. A process as defined by claim 37 wherein said coal is selected from the group consisting of lignite and a sub-bituminous coal and said liquid hydrocarbon carrier is a natural crude oil.

43. A process as defined by claim 42 wherein said sub-bituminous coal is Obed Mountain coal.

44. A process as defined by claim 29 further comprising the steps of:

(c) passing said mixture through a pipeline to a location where said solids are to be separated from said liquid hydrocarbon carrier; and (d) separating, at said location, said carbonaceous solids from said liquid hydrocarbon carrier such that greater than about 70 weight percent of the carrier originally present in said mixture is recovered and said recovered carrier contains less than about 0.5 weight percent solids.

45. A process as defined by claim 44 wherein said separated liquid hydrocarbon carrier is essentially free of water.

46. A process for preparing a mixture of coal and a liquid hydrocarbon carrier, transporting said mixture through a pipeline, and subsequently separating said coal from said liquid hydrocarbon carrier, which process comprises:

(a) combining coal with a liquid hydrocarbon carrier and water to form a slurry, said slurry containing water-saturated coal and water in excess of the amount in said water-saturated coal;

(b) agitating said slurry under high shear conditions;

(c) transporting the slurry from step (b) through a pipeline to a location where said coal is to be separated from said liquid hydrocarbon carrier; and (d) separating, at said location, the coal in said transported slurry from the liquid hydrocarbon carrier such that greater than about 70 weight percent of the carrier originally present in said transported slurry is recovered and said recovered carrier contains less than about 2.5 weight percent coal.

47. A process a defined by claim 46 wherein said separated liquid hydrocarbon carrier is essentially free of water.

48. A process as defined by claim 46 wherein said coal is selected from the group consisting of lignite and a sub-bituminous coal having a water-saturation level above about 9 weight percent.

49. A process as defined by claim 48 wherein said liquid hydrocarbon carrier is a natural gas condensate.

50. A process as defined by claim 46 wherein said mixture formed in step (a) further comprises a surfactant substantially insoluble in said carrier liquid.

51. A process as defined by claim 50 wherein said surfactant has an HLB value between about 12 and about 16.

52. A process as defined by claim 51 wherein said surfactant comprises a polymeric chain averaging between about 7 and about 30 polyethylene oxide units and terminated, at one end, with nonyl phenol.

53. A process as defined by claim 51 wherein said coal is selected from the group consisting of lignite and a sub-bituminous coal having a water-saturation level greater than about 9 weight percent, and said liquid hydrocarbon carrier is a natural crude oil.

54. A process as defined by claim 46 wherein said slurry is agitated in step (b) at a shear rate greater than 20,000 reciprocal seconds.

55. A process as defined by claim 46 wherein said slurry from step (b) is transported over about 100 miles through said pipeline to said predetermined destination.

56. A process as defined by claim 46 wherein said slurry from step (b) is transported over about 1,000 miles through said pipeline to said predetermined destination.

57. A mixture as defined by claim 10 substantially free of a surfactant or stabilizer.

58. A process as defined by claim 35 wherein said mixture of coal and natural gas condensate is substantially free of a surfactant or stabilizer.

59. A process for making a mixture of coal and a liquid hydrocarbon carrier, said mixture being suitable for transportation through a pipeline and the subsequent separation of said coal from said carrier, which process comprises:

(a) combining coal with a liquid hydrocarbon carrier and water to form a slurry, said slurry containing water-saturated carbonaceous solids and water in excess of the amount in said water-saturated solids; and (b) agitating said slurry at a shear rate between about 20,000 and about 60,000 reciprocal seconds.

60. A process as defined by claim 59 wherein said liquid hydrocarbon carrier is a natural gas condensate and said mixture is substantially free of a surfactant.

61. A process as defined by claim 59 wherein said liquid hydrocarbon carrier is a natural crude oil and a surfactant having an HLB value above 10 is added to said slurry prior to or during step (b), said surfactant being substantially insoluble in said natural crude oil.

* * * * *